US006432275B1

(12) United States Patent
Huovila et al.

(10) Patent No.: US 6,432,275 B1
(45) Date of Patent: Aug. 13, 2002

(54) HEADBOX OF A PAPER/BOARD MACHINE BY WHOSE MEANS THE BASIS WEIGHT OF THE WEB CAN BE REGULATED

(75) Inventors: Jyrki Huovila, Muurame; Petri Nyberg; Antti Suoperä, both of Jyväskylä; Tapani Nyman, Karhula, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/622,336

(22) PCT Filed: Feb. 11, 1999

(86) PCT No.: PCT/FI99/00103

§ 371 (c)(1),
(2), (4) Date: Aug. 11, 2000

(87) PCT Pub. No.: WO99/41449

PCT Pub. Date: Aug. 19, 1999

(30) Foreign Application Priority Data

Feb. 13, 1998 (FI) ..... 980336

(51) Int. Cl.[7] ..... D21F 1/06; D21F 1/08
(52) U.S. Cl. ..... 162/343; 162/258; 162/259
(58) Field of Search ..... 162/336, 343, 162/258, 259, 216

(56) References Cited

U.S. PATENT DOCUMENTS

| | | | | |
|---|---|---|---|---|
| 4,888,094 A | | 12/1989 | Weisshuhn et al. | 162/198 |
| 5,490,905 A | * | 2/1996 | Huovila et al. | 162/343 |
| 5,885,420 A | * | 3/1999 | Heinzmann et al. | 162/258 |
| 5,944,957 A | * | 8/1999 | Fagerlund et al. | 162/258 |

FOREIGN PATENT DOCUMENTS

DE 4234940 2/1993

* cited by examiner

*Primary Examiner*—Karen M. Hastings
(74) *Attorney, Agent, or Firm*—Steinberg & Raskin, P.C.

(57) ABSTRACT

The invention concerns a headbox for a paper/board machine by whose means the basis weight of the web can be regulated. The headbox comprises a stock inlet header ($J_l$), which becomes narrower towards its end. Tubes (11$a_1$, 11$a_2$ . . . ) in a tube bank (11) open in the stock inlet header ($J_1$) across the machine width, which tubes are connected with thickening elements (12$a_1$, 12$a_2$ . . . ) across the machine width, in which connection a flow ($L_1$) is removed from the thickening element into the duct ($D_1$) and said flow ($L_1$) to be removed is regulated by means of a valve ($V_1$, $V_2$ . . . ). From the thickening element (12$a_1$, 12$a_2$ . . . ) a tube (14$a_1$, 14$a_2$ . . . ) for a flow ($L_2$) of higher consistency is provided, which flow is passed further in the headbox.

27 Claims, 5 Drawing Sheets

HEADBOX OF A PAPER/BOARD MACHINE BY WHOSE MEANS THE BASIS WEIGHT OF THE WEB CAN BE REGULATED

FIELD OF THE INVENTION

The invention concerns a headbox for a paper/board machine by whose means the basis weight of the web can be regulated.

BACKGROUND OF THE INVENTION

From the prior art, regulation of the basis weight of a web (paper/board web) across the web width is known so that a dilution fluid, favourably dilution water, is passed to the desired area of width of the headbox. Thus, the dilution water is passed to the desired area of width into connection with the stock flow passed from the stock inlet header. The dilution water is favourably passed from an inlet header of its own through separate flow ducts, which flow ducts comprise a valve that regulates the flow. By means of regulation of the valve, the dilution fluid can be passed to the desired areas of width of the web and as the desired quantities.

From the U.S. Pat. No. 4,888,094 of Weisshuhn, a method is known for regulation of a flow, in which method a certain flow is passed out of the desired area of the width of the headbox. Further, in respect of the prior art, reference is made to the publication DE 42 34 940.

OBJECT AND SUMMARY OF THE INVENTION

In the present patent application, a method of an entirely novel type is suggested for regulation of the basis weight of a web, which method is based on removal of a flow component whose concentration differs from the average stock concentration out of the stock flow. In accordance with the invention, it has been realized to employ a separate thickening element, which comprises a chamber space, into which chamber an inlet tube is opened and out of which chamber an outlet duct departs. Through a central discharge duct, the main flow is passed further, and the proportion whose concentration differs from the average concentration of the stock suspension and which contains a smaller amount of fibers and whose basis weight is lower than the average basis weight of the stock is passed first out of the side walls of the tube that passes into the chamber space of the thickening element and after that away from the side face of the chamber space through a duct which opens at said face. In the inlet tube that passes into the thickening element, the flow tends to be differentiated so that the proportion with a higher concentration of solid matter flows in the middle of the tube, and the proportion with a lower concentration of fibers flows in the lateral areas of the tube. Said lateral proportion is passed further into the chamber space of the thickening element and away from the chamber space through the duct placed at the side wall of the chamber space. When the flow is passed into the thickening element, the total flow is denoted with L. At the thickening element, when the flow enters into the thickening element, the flow L consists of a flow proportion $L_2$ flowing in the middle of the inlet tube and passed forwards, and of a flow proportion $L_1$ flowing along the faces of the tube and to be removed from the headbox. The middle flow $L_2$ contains a higher concentration of solid matter than the flow proportion $L_1$ to be removed does. The flow $L_2$ is passed forwards in the headbox, and the flow $L_1$ is removed through the thickening element.

Thus, the central flow $L_2$ with a higher concentration of fibers is passed forwards, and the flow $L_1$ with a lower concentration of fibers, from the walls of the tube, is removed through the thickening element. The flow $L_2$ which is passed from the thickening element forwards in the headbox is a what is called differential flow and equal to $=L-L_1$. The flow quantity (liters per minute) of the flow L is always invariable. As the flow quantity of the flow proportion $L_1$ removed from the headbox can be regulated by means of the valves $V_1$, $V_2$, it is further possible to regulate the concentration of the central flow $L_2$. Thus, by means of said flow $L_2$, it is further possible to regulate the basis weight of the web as desired across the web width. In order that the quantity of the flow $L_2$ should remain invariable, the proportion $L_1$ to be removed must be compensated for by a corresponding increase in the flow introduced into the thickening element.

In a preferred embodiment of the invention, the thickening element is fitted in the vicinity of the stock inlet header of the headbox. In said embodiment, when the flow proportion $L_1$ ($X_1$ liters per minute) is removed, the flow quantity of the flow passed from the inlet header is increased with an equal amount $X_1$ liters per minute, and, thus, the differential flow $L-L_1=L_2$ is invariable. Said compensation for the flow quantity ($X_1$ liters per minute) that has been passed away takes place, in an embodiment of the invention, so that a separate duct is passed from the stock inlet header to the outlet side of the thickening element. Thus, through said duct it is possible to pass a compensation flow $L_3$ into connection with the flow $L_2$. The sum flow $L_3+L_2$ is always as desired and unchanged, i.e. invariable. Herein, when flows are spoken of (e.g. sum flow and differential flow), what is meant is flow quantity per unit of time, for example liters per minute.

The headbox in accordance with the invention for regulation of the basis weight of the web in a paper/board machine is characterized in what is stated in the patent claims.

BRIEF DESCRIPTION OF THE DRAWINGS

The invention will be described in the following with reference to some preferred embodiments of the invention illustrated in the figures in the accompanying drawings, the invention being, yet, not supposed to be confined to said embodiments alone.

DETAILED DESCRIPTION OF THE INVENTION

Figure 1:
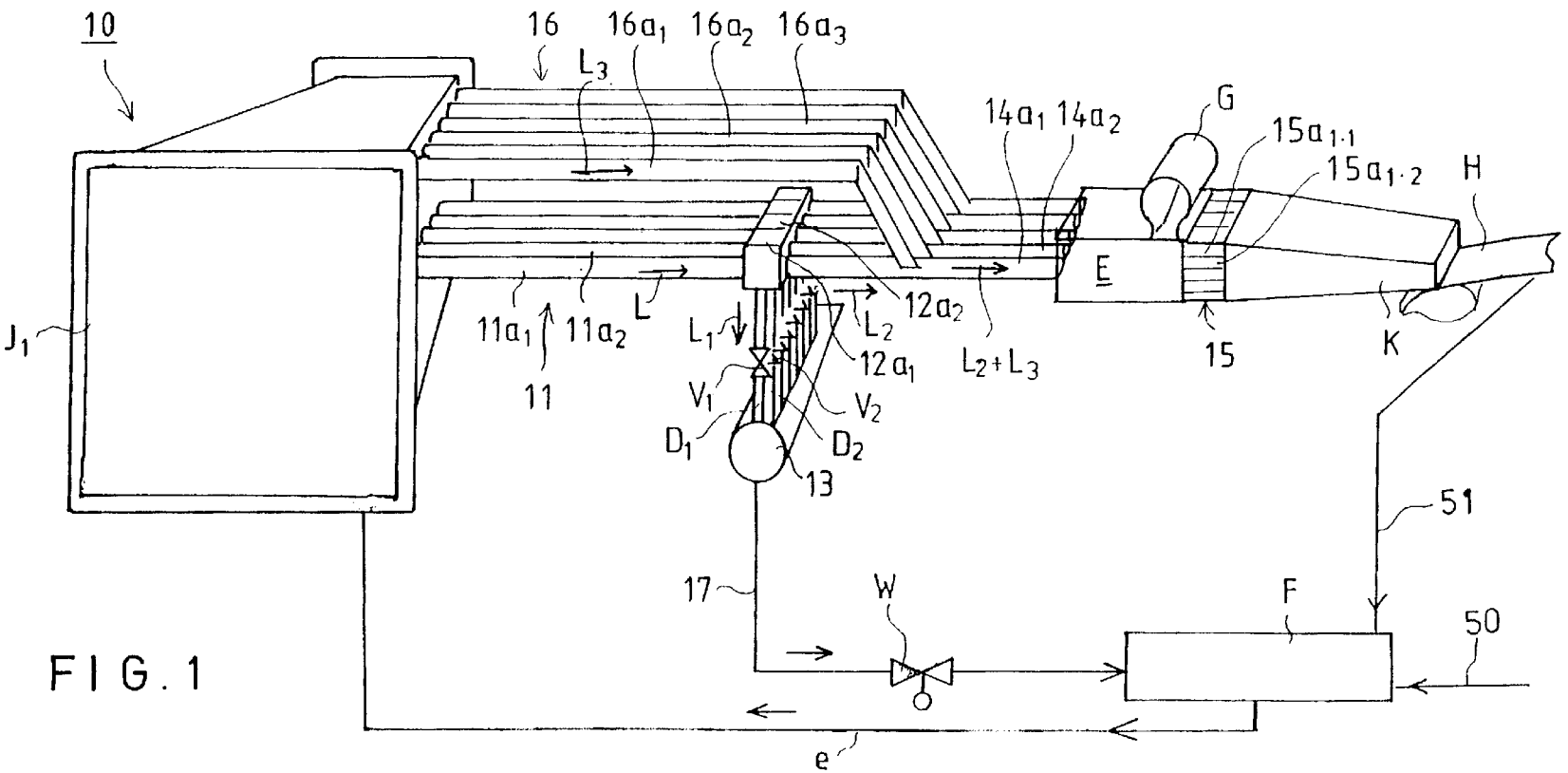
FIG. 1 is an axonometric view of an equipment in accordance with the invention, being partly an illustration of principle.

FIG. 1 shows a headbox construction 10 in accordance with the invention. As is shown in the figure, the headbox 10 comprises a stock inlet header $J_1$, which becomes narrower towards its end in the cross direction and from which header the stock is passed, in the embodiment shown in FIG. 1, through the tubes 11$a_1$, 11$a_2$ . . . in the single-row tube bank 11 further to thickening elements 12$a_1$, 12$a_2$, 12$a_3$ . . . . Each tube 11$a_1$, 11$a_2$ . . . is connected with a thickening element 12$a_2$, 12$a_2$ . . . . In the thickening element 12$a_1$, 12$a_2$ . . . , which is illustrated in more detail in FIG. 2A, part of the stock flow is removed from the lateral areas of the stock flow into the ducts $D_1$, $D_2$ . . . and further into a collecting header 13 as a flow proportion $L_1$. Thus, from each thickening element 12$a_1$, 12$a_2$ . . . , a duct $D_1$, $D_2$ . . . of its own passes to the collecting header 13. Each duct $D_1$, $D_2$ . . . is provided with a valve $V_1$, $V_2$ . . . , by whose means it is possible to regulate the flow $L_1$ to be removed from the thickening element 12$a_1$, 12$a_2$ . . . . The flow $L_1$ is taken in the thickening element 12$a_1$, 12$a_2$ . . . from the lateral areas of the chamber space 18 (in FIG. 2A). Said removed proportion or component of the flow differs, in respect of its consistency, from the flow $L_2$ that is passed further, which flow $L_2$ is passed further expressly from the middle of the thickening element 12$a_1$, 12$a_2$ . . . .

From the thickening elements 12$a_1$, 12$a_2$ . . . , the tubes 14$a_1$, 14$a_2$, 14$a_3$ . . . in the single-row tube bank pass into an intermediate chamber E, which is opened from the top into a stilling chamber G and from which intermediate chamber E the stock flow is passed into the tubes 15$a_{1.1}$, 15$a_{1.2}$ in the turbulence generator 15 and further into the slice cone K and onto the forming wire H.

In order that the flow quantity should not be changed as a function of the removed flow $L_1$, to the tube bank 14, after the thickening elements 12$a_1$, 12$a_2$ . . . , additional-flow ducts 16$a_1$, 16$a_2$, 16$a_3$ . . . have been connected. They are connected to the tubes 14$a_1$, 14$a_2$ . . . placed after the thickening elements 12$a_1$, 12$a_2$ . . . . Their inlet ends communicate with the inlet header $J_1$. Through the ducts 16$a_1$, 16$a_2$ . . . , an additional flow $L_3$ is passed into connection with the flow $L_2$ coming from the thickening elements 12$a_1$, 12$a_2$ . . . . The additional flow $L_3$ compensates for the flow quantity $L_1$ that has been removed at each thickening element 12$a_1$, 12$a_2$ . . . , so that the flow quantity $L_2+L_3$ is always unchanged, i.e. invariable, after each thickening element 12$a_1$, 12$a_2$ . . . .

As is shown in the figure, further, from the collecting header 13 there is a duct 17 through the valve W to the wire pit F. From the wire pit F, there is a return duct e back to the inlet header $J_1$ of the headbox, however, so that by means of the flow passed from the return duct, new fresh stock is diluted for the headbox construction. The new fresh stock is passed into the wire pit F along the duct 50, and white water is passed along the duct 51 into the wire pit F.

Figure 2A:
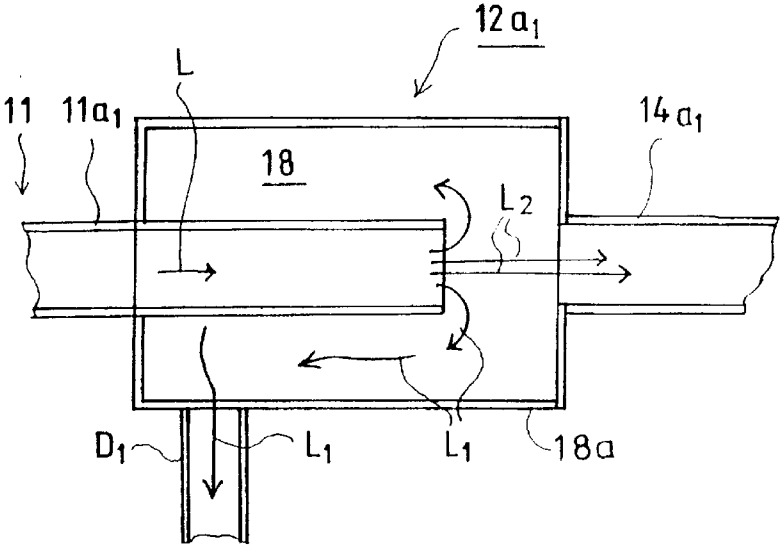
FIG. 2A is a sectional view of a thickening unit employed in the equipment in accordance with the invention.

FIG. 2A is a sectional view of a thickening element 12$a_1$. The thickening element 12$a_1$ comprises a chamber space 18, to which a tube 11$a_1$ of the tube bank 11 is connected from the inlet side. The tube 11$a_1$ extends into the interior of the chamber space 18 similarly to a projection. Out of the chamber space 18, there is an exhaust duct 14$a_1$. The flow $L_1$, whose consistency differs from the consistency of the stock flow $L_2$ passing in the middle of the tube 11$a_1$, is transferred from the lateral areas 18*c* of the thickening element 12$a_1$, 12$a_2$ . . . out of the chamber space 18 as exhaust into the duct $D_1$. The component $L_2$ of higher consistency taken from the middle of the thickening element 12$a_1$, 12$a_2$ . . . is transferred further in the headbox and first into the tube 14$a_1$.

Figure 2B:
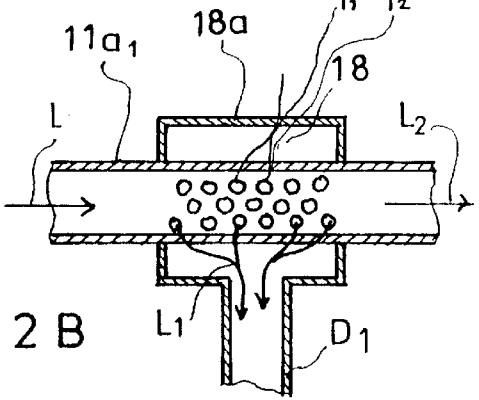
FIG. 2B shows a second embodiment of a thickening element in accordance with the invention.

FIG. 2B illustrates a second preferred embodiment of a thickening element 12$a_1$, 12$a_2$ . . . . In the embodiment shown in the figure, the thickening element 12$a_1$ comprises a frame 18*a* preferably a tubular frame, which confines a chamber space 18 in its interior. Through the chamber space 18, a tube 11$a_1$ is passed, which tube comprises flow openings $f_1$, $f_2$, $f_3$ . . . , which open into the chamber space 18*a*. Through the flow openings $f_1$, $f_2$, $f_3$ . . . a flow $L_1$ with a lower concentration of fibers is passed, which flow $L_1$ is passed further into the duct $D_1$ and out of connection with the headbox. The embodiment of the invention shown in FIG. 2B is in the other respects similar to the embodiments shown in the preceding figures, the only difference being that the thickening element 12$a_1$ comprises a perforated $f_1$, $f_2$ . . . tube portion 11$a_1$, 11$a_2$ . . . passing through the chamber space 18*a*. When fitted in a headbox as shown in FIG. 1, a thickening element as shown in FIG. 2A or 2B is placed so that its distance from the inlet header $J_1$ is larger than 5×diameter n of the tube 11$a_1$, preferably 10 . . . 20 times the diameter n of the tube 11$a_1$. In the embodiment of FIG. 2B, the headbox comprises a stock inlet header $J_1$ and from it, as is shown in the embodiment of FIG. 4A, flow tubes 11$a_1$, 11$a_2$ passing into the intermediate chamber E and further from it, through the tubes 15$a_{1.1}$, 15$a_{1.2}$ in the turbulence generator 15, the flow is passed into the slice cone K and further onto the forming wire $H_1$.

Figure 2D:
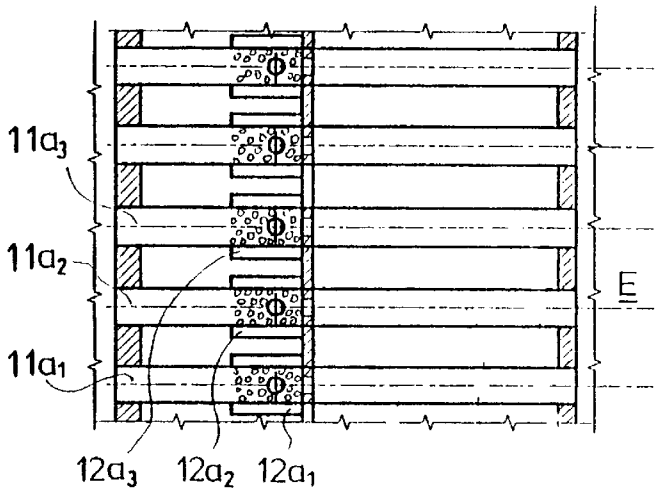
FIG. 2D is a sectional view taken along the line II—II in FIG. 2C.
Figure 2C:
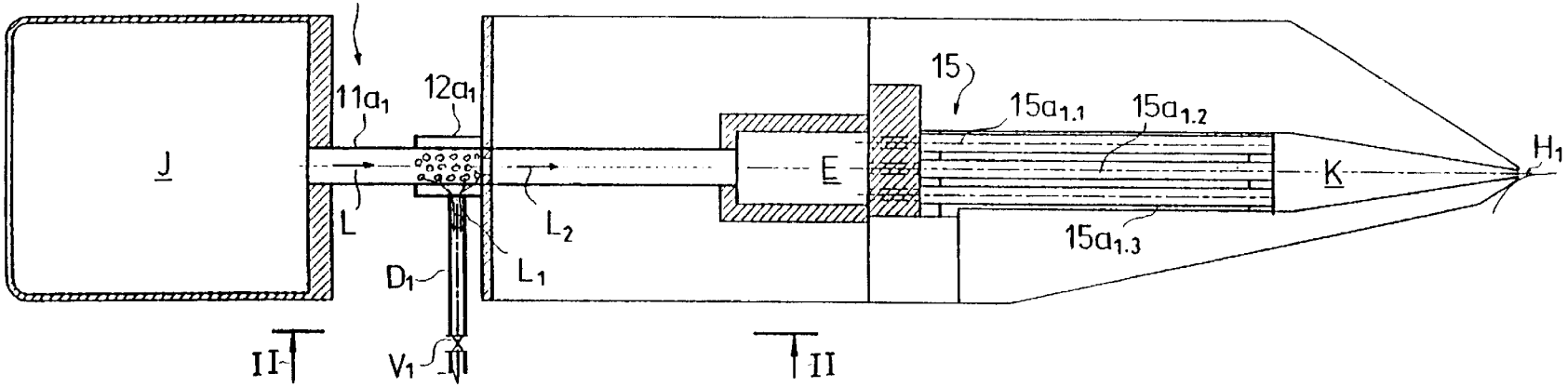
FIG. 2C shows an embodiment of a headbox connected with the thickening element shown in FIG. 2B.

FIG. 2C shows an embodiment related to the thickening element 12*a* shown in FIG. 2B. In this illustration, the thickening elements 12$a_1$, 12$a_2$ . . . are connected with flow tubes 11$a_1$, 11$a_2$ . . . which open into the intermediate chamber E. From the intermediate chamber, the flow passes into the turbulence generator 15 and from it further through the slice cone onto the forming wire H.

FIG. 2D is a sectional view taken along the line II—II in FIG. 2C. Thickening elements 12$a_1$, 12$a_2$ . . . have been fitted in different positions of width of the headbox in view of regulation of the basis weight of the web across the web width as desired.

Figure 3B:
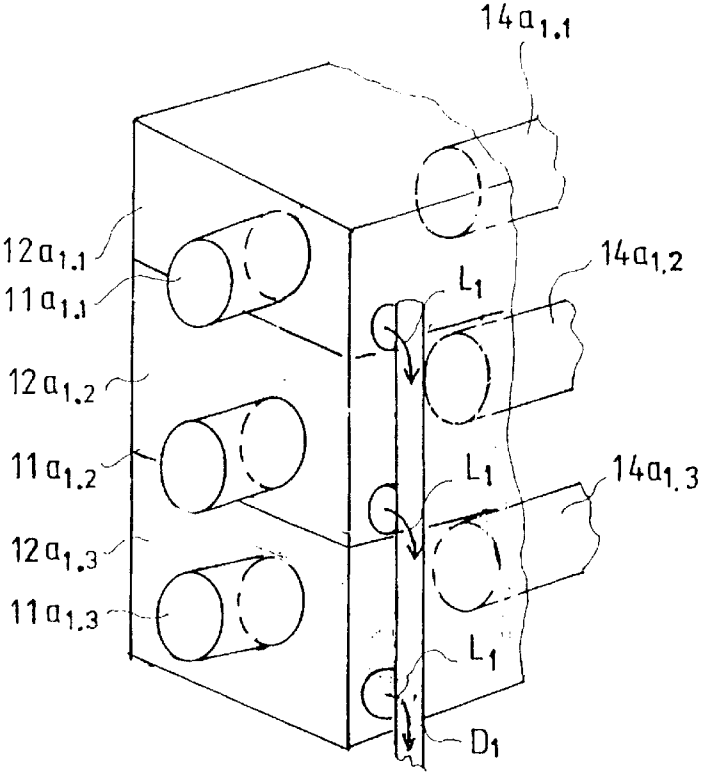
FIG. 3B shows a set of thickening elements in an area of width for use in the construction as shown in FIG. 3A.
Figure 3A:
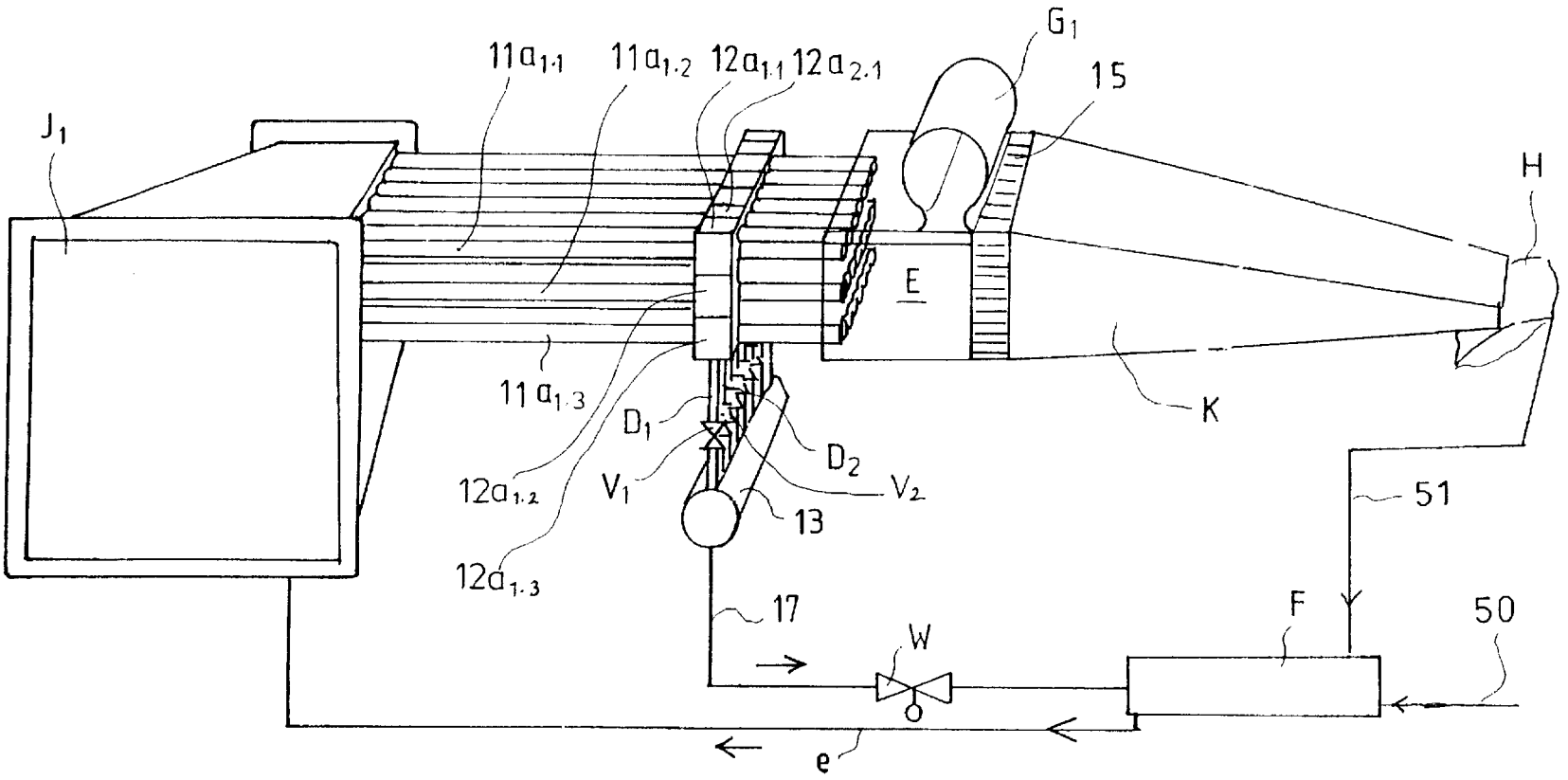
FIG. 3A shows an embodiment of the invention in which the thickening elements have been fitted right in the vicinity of the intermediate chamber of the stilling chamber G and in which construction the stilling chamber O is provided with an overflow.

FIG. 3A shows an embodiment of the invention in which the thickening elements 12$a_1$, 12$a_2$ . . . have been fitted right in the vicinity of the intermediate chamber E, into which intermediate chamber E further a stilling chamber G is opened. If the diameter of the tubes 11$a_1$, 11$a_2$ . . . passing to the thickening elements 12$a_1$, 12$a_2$ . . . is denoted with n, the length L of the tubes 11$a_1$, 11$a_2$ . . . is larger than 5×n, and preferably (10 . . . 20)×n. When the tubes 11$a_1$, 11$a_2$ . . . are formed sufficiently long, a consistency profile has time to be formed in the flow in the tube. In the embodiment shown in FIG. 3A, when the construction is provided with a stilling chamber G connected with the intermediate chamber E and when the thickening elements 12$a_1$, 12$a_2$ . . . are fitted as close to the intermediate chamber E as possible, variations in the flow quantity of the differential flow $L-L_1=L_2$ arising from the removed flow $L_1$ are compensated for by means of the overflow of the stilling chamber G. In this way, the flow quantity of the flow $L_2$ which is passed from the thickening elements $12a_1$, $12a_2$ . . . further into the intermediate chamber E is kept unchanged, i.e. invariable.

FIG. 3B is a separate illustration showing thickening elements $12a_{1.1}$, $12a_{1.2}$ and $12a_{1.3}$ placed one above the other at one position of width. The figure is a schematic illustration. From each of the thickening elements $12a_{1.1}$, $12a_{1.2}$ and $12a_{1.3}$ placed one above the other, a flow $L_1$ is passed into the duct $D_1$. Ducts or tubes $11a_{1.1}$, $11a_{1.2}$ and $11a_{1.3}$ pass to the thickening elements $12a_{1.1}$, $12a_{1.2}$ and $12a_3$, and for the flows $L_2$ departing from the thickening elements, there are ducts or tubes $14a_{1.1}$, $14a_{1.2}$ and $14a_{1.3}$.

FIG. 4A shows an embodiment of the invention in which the thickening elements $12a_1$, $12a_2$ have been fitted in the vicinity of the stock inlet header $J_1$ of the headbox so as to be connected with the flow tubes $11a_1$, $11a_2$ . . . The length of the tubes $11a_1$, $11a_2$ . . . is larger than 2–n, wherein n is the diameter of the tube $11a_1$, $11a_2$. Preferably, the length of the tube $11a_1$, $11a_2$ is in the range (5 . . . 15)×n, i.e. 5 . . . 15 times the diameter of the tube $11a_1$, which diameter is denoted with the letter n. When the stock that flows in the tube portions $11a_1$, $11a_2$ is denoted with the reference arrow L, at the thickening element the flow L consists of the flow proportions $L_1+L_2$, in which the flow proportion $L_1$ flows along the walls of the tube $11a_1$, $11a_2$ . . . , and the flow proportion $L_2$ flows in the middle of the tube $11a_1$, $11a_2$ . . . The proportion flowing along the walls is passed through the thickening unit $12a_1$, $12a_2$ . . . into the chamber 18 of the thickening unit and further away from the thickening unit $12a_1$, $12a_2$ . . . The flow $L_2$ is passed further, and the flow $L_2$, which is a differential flow, can be written as $L_2=L-L_1$. The fact that the flow $L_2$ remains invariable is permitted by the fact that the thickening unit is placed in the vicinity of the inlet header $J_1$, in which case the pressure in the inlet header $J_1$ equalizes the flow quantities. The more flow $L_1$ is removed, the more is the flow L that is passed from the inlet header $J_1$ into the tube $11a_1$, $11a_2$ . . . increased. Thus, the differential flow $L_2$ remains invariable after each thickening element $12a_1$,$12a_2$ . . . .

As is shown in the figure, the flow $L_2$ is passed further into the intermediate chamber E and further through the tubes $15a_{1.1}$, $15a_{1.2}$ . . . in the turbulence generator 15 into the slice cone K and further onto the forming wire H. As is shown in the figure, from the collecting header 13, there is a duct 17 further through the valve W into the wire pit F. From the wire pit F, there is a return duct e passing back to the inlet header $J_1$ of the headbox, however, so that, by means of the flow passed from the return duct, the new fresh stock is diluted for the headbox construction. The new fresh stock is passed into the wire pit F along the duct 50, and white water is passed along the duct 51 into the wire pit F.

Figure 4B:
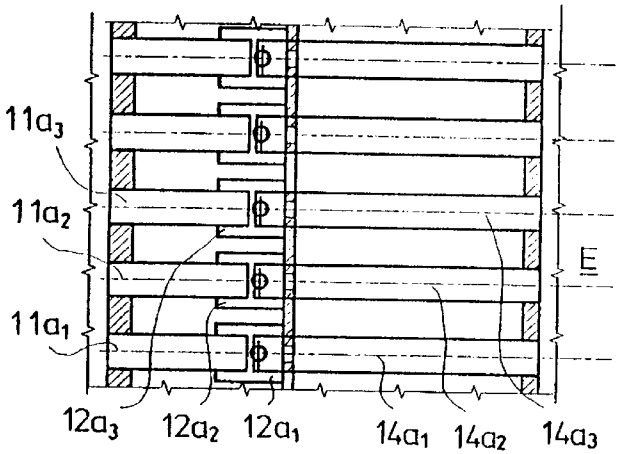
FIG. 4B is a sectional view taken along the line I—I in FIG. 4A.
Figure 4A:
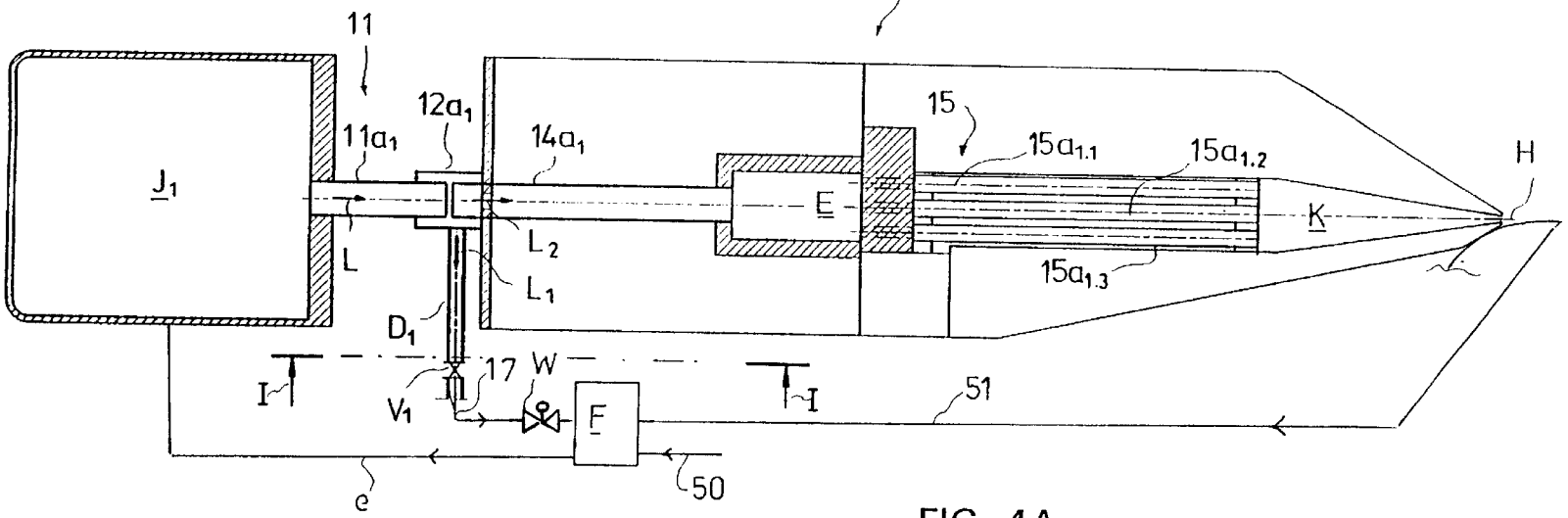
FIG. 4A shows an embodiment of the invention in which the thickening elements have been arranged right in the vicinity of the stock inlet header at a suitable distance from the stock inlet header, in which connection both there is time for a concentration profile to be formed and the pressure in the stock inlet header equalizes the flows so that the flow $L_1$ that is removed from the thickening element is compensated for by an additional-flow quantity passed from the stock inlet header.

FIG. 4B is a sectional view taken along the line I—I in FIG. 4A. As is shown in the figure, the thickening elements $12a_1$, $12a_2$ . . . $12a_n$ have been fitted at different positions of the width of the headbox, in which case, by means of the flows removed through the thickening elements, it is possible to regulate the basis weight of the web across the web width by regulating the concentration of the stock $L_2$ that is made to flow from the thickening elements further in the headbox. If the valve $V_1$, $V_2$ . . . of the thickening unit $12a_1$, $12a_2$ . . . is kept closed, no flow is removed through the thickening unit $12a_1$, $12a_2$ . . . , and in such a case the flow $L_1=0$, and the differential flow, i.e. the flow quantity that is made to flow forwards from the thickening unit, is equal to the flow L that enters into the thickening unit. In such a case, $L_2=L$. However, in the construction in accordance with the present invention, the flow proportion $L_2$ that is made to flow from the thickening unit further in the headbox is invariable under all circumstances irrespective of the quantity of the flow $L_1$ that is removed.

What is claimed is:

1. A headbox for a paper/board machine by whose means the basis weight of the web can be regulated, wherein the headbox comprises a stock inlet header ($J_1$), which becomes narrower towards its end, tubes ($11a_1$, $11a_2$ . . . ) in a tube bank (11), which tubes open in the stock inlet header ($J_1$) across the machine width and which tubes are connected with thickening elements ($12a_1$, $12a_2$ . . . ) across the machine width, in which connection a flow ($L_1$) is removed from the thickening element into the duct ($D_1$) and said flow ($L_1$) to be removed is regulated by means of a valve ($V_1$, $V_2$ . . . ), and from which thickening element ($12a_1$, $12a_2$ . . . ) a tube ($14a_1$, $14a_2$ . . . ) for a flow ($L_2$) of higher consistency is provided, which flow is passed further in the headbox, and that, by means of the pressure present in the inlet header ($J_1$), the flow ($L_2$) that departs from the thickening elements ($12a_1$, $12a_2$ . . . ) is always kept invariable irrespective of the amount of flow ($L_1$) that is removed through the thickening element ($12a_1$, $12a_2$ . . . ).

2. A headbox as claimed in claim 1, wherein the thickening elements ($12a_1$, $12a_2$ . . . ) have been fitted in the vicinity of the inlet header ($J_1$)

3. A headbox as claimed in claim 1, wherein the length of the flow tube ($11a_1$, $11a_2$ . . . ) passing between the inlet header ($J_1$) and the thickening element ($12a_1$) placed in the vicinity of the inlet header is larger than 2×n, wherein n is the diameter of the tube ($11a_1$, $11a_2$ . . . ), and the length of the tube ($11a_1$)is in the range of 5×n to 15×n.

4. A headbox as claimed in claim 1, weherein the thickening elements ($12a_1$, $12a_2$ . . . ) have been fitted in the vicinity of the intermediate chamber (E) in the headbox, into which chamber (E) a stilling chamber (G) opens, by means of whose overflow the flow is equalized so that the flow quantity of the flow that arrives from the thickening element ($12a_1$, $12a_2$ . . . ) into the intermediate chamber (E) is always invariable irrespective of the flow quantity of the flow ($L_1$) that is removed through the thickening element ($12a_1$, $12a_2$ . . . ), in which connection the flow ($L_2$) is kept invariable by means of the overflow from the stilling chamber (G).

5. A headbox as claimed in claim 1, wherein a duct ($16a_1$, $16a_2$ . . . ) connected with the inlet header ($J_1$) is connected to the tube ($14a_1$, $14a_2$ . . . ), in which connection, by means of a stock flow ($L_3$) passed through said flow duct, it is possible to compensate for the flow ($L_1$) that is removed through each thickening element ($12a_1$, $12a_2$ . . . ), in which case the flow quantity of the sum flow ($L_2+L_3$) after each thickening element ($12a_1$, $12a_2$ . . . ), as viewed in the direction of flow, is invariable.

6. A headbox as claimed in claim 1, wherein the thickening element ($12a_1$, $12a_2$ . . . ) comprises a chamber space (18), into whose interior a tube ($11a_1$, $11a_2$ . . . ) is opened from the inlet side, and that said inlet side tube ($11a_1$, $11a_2$ . . . ) extends into the chamber space (18), and that at the outlet side, said chamber space (18) is connected with a tube ($14a_1$, $14a_2$ . . . ), into which the proportion of stock flow with a higher concentration is collected from the middle, and that the proportion that has a concentration more dilute than the concentration of said middle proportion and whose dry solids content is lower is transferred into an exhaust duct ($D_1$, $D_2$ . . . ) placed at the side face of the frame (18*a*), a tube or equivalent, that defines the chamber space (18) in the thickening element ($12a_1$, $12a_2$ . . . ).

7. A headbox as claimed in claim 1, wherein the thickening element ($12a_1$, $12a_2$ . . . ) consists of a frame (18*a*), which defines a chamber space (18) in its interior, and that a tube (11$a_1$) passes through the frame (18*a*), in which tube a stock is made to flow, and that the tube ( 11$a_1$) comprises flow openings ($f_1$, $f_2$, $f_3$), through which the flow ($L_1$) to be removed is passed, which flow is passed first into the chamber space (18) and further into the duct ($D_1$) and out of connection with the headbox.

8. A headbox as claimed in claim 1, wherein the flows from the outlet ducts ($D_1$, $D_2$ . . . ) are collected in a collecting header (13) and passed further through a duct (17) into the wire pit (F), and that the duct (17) comprises a valve (W) for regulation of the flow, and there is a return duct (e) from the wire pit (F) back to the stock inlet header ($J_1$) of the headbox.

9. A headbox as claimed in claim 5, wherein a combined flow ($L_1$+$L_3$) is transferred into the intermediate chamber (E) in the headbox, which chamber is opened into a stilling chamber (G), and from which intermediate chamber (E) the flow is transferred through the tubes (15$a_1$, 15$a_2$ . . . ) in the turbulence generator (15) further into the slice cone (K) and further onto the forming wire (H).

10. A headbox for a paper/board machine, comprising:

a stock inlet header for providing a stock flow, said stock inlet header having a first end, a second end and structured and arranged so that it is tapered from said first end towards said second end;

a tube bank including a plurality of tubes in flow communication with said stock inlet header, each of said tubes being connected to a thickening element for removing a portion of said stock flow from a corresponding one of said tubes to thereby increase the consistency of said stock flow;

means for regulating the flow from the thickening element;

at least one tube in flow communication with each of said tubes at a point after said thickening element for passing said stock flow further in said headbox; and a duct having a first end in flow communication with said inlet header and a second end in communication with said at least one tube in flow communication with each of said tubes at a point after said thickening element for passing said stock flow further in said headbox, said duct being adapted for maintaining a quantity of said stock flow in said at least one tube constant irrespective of the amount of stock flow removed by said thickening elements.

11. The headbox according to claim 10, wherein said thickening elements are arranged near said inlet header.

12. The headbox according to claim 10, wherein each of said tubes in said tube bank have a length between said inlet header and said thickening element greater than 2×n, wherein n is the diameter of the tube.

13. The headbox according to claim 10, wherein each of said tubes in said tube bank have a length between said inlet header and said thickening element from about 5×n to about 15×n.

14. The headbox according to claim 10, further comprising:

an intermediate chamber in flow communication with said at least one tube in flow communication with each of said tubes at a point after said thickening element for passing said stock flow further in said headbox;

a stilling chamber in communication with said intermediate chamber for maintaining a flow quantity of said stock flow arriving in said intermediate chamber constant irrespective of the amount of stock flow removed by said thickening elements.

15. The headbox according to claim 14, further comprising:

a turbulence generator in flow communication with said intermediate chamber; and a slice cone in flow communication with said turbulence generator.

16. A headbox for a paper/board machine, comprising:

a stock inlet header for providing a stock flow, said stock inlet header having a first end, a second end and structured and arranged so that it is tapered from said first end towards said second end;

a tube bank including a plurality of tubes in flow communication with said stock inlet header, each of said tubes being connected to a thickening element for removing a portion of said stock flow from a corresponding one of said tubes to thereby increase the consistency of said stock flow;

means for regulating the flow from the thickening element;

at least one tube in flow communication with each of said tubes at a point after said thickening element for passing said stock flow further in said headbox; and wherein said thickening element comprises a chamber having an inlet and an outlet, said inlet being in flow communication with a corresponding one of said tubes for said tube bank and said outlet being in flow communication with said at least one tube in flow communication with each of said tubes at a point after said thickening element for passing said stock flow further in said headbox.

17. The headbox according to claim 16, wherein said thickening elements are arranged near said inlet header.

18. The headbox according to claim 16, wherein each of said tubes in said tube bank have a length between said inlet header and said thickening element greater than 2×n; wherein n is the diameter of the tube.

19. The headbox according to claim 16, wherein each of said tubes in said tube bank have a length between said inlet header and said thickening element from about 5×n to about 15×n.

20. The headbox according to claim 16, further comprising:

an intermediate chamber in flow communication with said at least one tube in flow communication with each of said tubes at a point after said thickening element for passing said stock flow further in said headbox;

a stilling chamber in communication with said intermediate chamber for maintaining a flow quantity of said stock flow arriving in said intermediate chamber constant irrespective of the amount of stock flow removed by said thickening elements.

21. The headbox according to claim 20, further comprising:

a turbulence generator in flow communication with said intermediate chamber; and a slice cone in flow communication with said turbulence generator.

22. A headbox for a paper/board machine, comprising:

a stock inlet header for providing a stock flow, said stock inlet header having a first end, a second end and structured and arranged so that it is tapered from said first end towards said second end;

a tube bank including a plurality of tubes in flow communication with said stock inlet header, each of said tubes being connected to a thickening element for removing a portion of said stock flow from a corresponding one of said tubes to thereby increase the consistency of said stock flow;

means for regulating the flow from the thickening element;

at least one tube in flow communication with each of said tubes at a point after said thickening element for passing said stock flow further in said headbox; and a plurality of ducts, each on of said plurality of ducts being in communication with a corresponding one of said thickening elements for receiving said a portion of said stock flow removed from said corresponding one of said tubes, a collecting header in flow communication with each of said plurality of ducts;

a second duct in flow communication with said collecting header which is in flow communication with a wire pit;

a valve for regulating the flow in said second duct;

a return duct from said wire pit and said stock inlet header.

23. The headbox according to claim 22, wherein said thickening elements are arranged near said inlet header.

24. The headbox according to claim 22, wherein each of said tubes in said tube bank have a length between said inlet header and said thickening element greater than 2×n, wherein n is the diameter of the tube.

25. The headbox according to claim 22, wherein each of said tubes in said tube bank have a length between said inlet header and said thickening element from about 5×n to about 15×n.

26. The headbox according to claim 22, further comprising:

an intermediate chamber in flow communication with said at least one tube in flow communication with each of said tubes at a point after said thickening element for passing said stock flow further in said headbox;

a stilling chamber in communication with said intermediate chamber for maintaining a flow quantity of said stock flow arriving in said intermediate chamber constant irrespective of the amount of stock flow removed by said thickening elements.

27. The headbox according to claim 26, further comprising:

a turbulence generator in flow communication with said intermediate chamber; and a slice cone in flow communication with said turbulence generator.

* * * * *

UNITED STATES PATENT AND TRADEMARK OFFICE

CERTIFICATE OF CORRECTION

PATENT NO. : 6,432,275 B1
DATED : August 13, 2002
INVENTOR(S) : Huovila, Jyrki et al.

It is certified that error appears in the above-identified patent and that said Letters Patent is hereby corrected as shown below:

Title page,
Item [75], the last name of the third inventor should be corrected to -- Suonpera. --

Signed and Sealed this

Thirty-first Day of December, 2002

JAMES E. ROGAN
*Director of the United States Patent and Trademark Office*